US011209015B2

(12) United States Patent
Ueno

(10) Patent No.: US 11,209,015 B2
(45) Date of Patent: Dec. 28, 2021

(54) CENTRIFUGAL COMPRESSOR

(71) Applicant: IHI Corporation, Koto-ku (JP)

(72) Inventor: Takahiro Ueno, Koto-ku (JP)

(73) Assignee: IHI Corporation, Koto-ku (JP)

( * ) Notice: Subject to any disclaimer, the term of this patent is extended or adjusted under 35 U.S.C. 154(b) by 468 days.

(21) Appl. No.: 16/305,478

(22) PCT Filed: Jun. 21, 2017

(86) PCT No.: PCT/JP2017/022876
§ 371 (c)(1),
(2) Date: Nov. 29, 2018

(87) PCT Pub. No.: WO2018/003632
PCT Pub. Date: Jan. 4, 2018

(65) Prior Publication Data

US 2021/0222703 A1 Jul. 22, 2021

(30) Foreign Application Priority Data

Jul. 1, 2016 (JP) ..... JP2016-131750

(51) Int. Cl.
*F04D 29/42* (2006.01)
*F04D 29/44* (2006.01)

(52) U.S. Cl.
CPC ..... *F04D 29/441* (2013.01); *F04D 29/422* (2013.01); *F04D 29/4206* (2013.01); *F05D 2220/40* (2013.01)

(58) Field of Classification Search
CPC ..... F04D 29/441; F04D 29/681
See application file for complete search history.

(56) References Cited

U.S. PATENT DOCUMENTS 8,545,177 B2 * 10/2013 Dettmann ..... F04D 29/441 415/203
9,874,224 B2 * 1/2018 Morita ..... F04D 29/422
2005/0232762 A1 10/2005 Smoke et al.
2010/0178163 A1 7/2010 Dettmann et al.
2012/0211205 A1 8/2012 Eguchi et al.
2013/0266432 A1 10/2013 Iwakiri et al.
(Continued)

FOREIGN PATENT DOCUMENTS

CN 2541643 Y 3/2003
CN 103261702 A 8/2013
(Continued)

OTHER PUBLICATIONS

International Search Report dated Aug. 15, 2017 in corresponding PCT/JP2017/022876, 2 pages.

*Primary Examiner* — Justin D Seabe
(74) *Attorney, Agent, or Firm* — Oblon, McClelland, Maier & Neustadt, L.L.P.

(57) ABSTRACT

In a compressor, a scroll includes a winding end portion, a discharge potion connected to the winding end portion, a winding start portion connected to the discharge potion, and a flow passage inner surface and when a projection plane is assumed for the scroll in a case in which a viewing point is located on a rotation axis of a compressor impeller and on a fluid suction side, and the flow passage inner surface on the projection plane includes a curved protrusion portion protruding outward in relation to the reference line.

9 Claims, 10 Drawing Sheets

(56) References Cited

U.S. PATENT DOCUMENTS

| | | | | |
|---|---|---|---|---|
| 2013/0272865 | A1 | 10/2013 | Hoshi et al. | |
| 2013/0294903 | A1 | 11/2013 | Tomita et al. | |
| 2015/0345515 | A1* | 12/2015 | Isogai ..... | F04D 29/4206 415/115 |
| 2018/0149170 | A1* | 5/2018 | Iwakiri ..... | F04D 29/44 |

FOREIGN PATENT DOCUMENTS

| | | | |
|---|---|---|---|
| JP | H3-217699 | A | 9/1991 |
| JP | H4-95697 | U | 8/1992 |
| JP | H7-224796 | A | 8/1995 |
| JP | H10-131895 | A | 5/1998 |
| JP | 2008-163803 | A | 7/2008 |
| JP | 2010-529358 | A | 8/2010 |
| JP | 2011-099413 | A | 5/2011 |
| JP | 2012-202323 | A | 10/2012 |
| JP | 2015-227619 | A | 12/2015 |
| WO | WO 2012/090853 | A1 | 7/2012 |

* cited by examiner (a)

(b)

CENTRIFUGAL COMPRESSOR

TECHNICAL FIELD

The present disclosure relates to a centrifugal compressor.

BACKGROUND ART

A centrifugal compressor in which a scroll is disposed in an outer peripheral portion of an impeller is known. The scroll is provided with a spiral flow passage. In this kind of centrifugal compressor, a gas which is compressed by the impeller is introduced into the scroll through a diffuser and is appropriately decreased in speed by the scroll to recover a static pressure (see Japanese Unexamined Utility Model Publication No. H4-95697). Additionally, a technology of an air conditioner including a multilayer centrifugal fan is also known (see Japanese Unexamined Patent Publication No. 2011-99413).

CITATION LIST

Patent Literature

Patent Literature 1: Japanese Unexamined Utility Model Publication No. H4-95697

Patent Literature 2: Japanese Unexamined Patent Publication No. 2011-99413

SUMMARY OF INVENTION

Technical Problem

However, as a result of a careful examination of the inventor, it was proved that the conventional centrifugal compressor had a possibility that pressure loss caused by a separation of a fluid from a flow passage inner surface might increase since the fluid is easily separated from the flow passage inner surface in the vicinity of a connection portion between a discharge potion and a winding start portion of the scroll.

The present disclosure will describe a centrifugal compressor capable of improving compression performance by reducing a separation of a fluid from a flow passage inner surface of a scroll.

Solution to Problem

An embodiment of the present disclosure provides a centrifugal compressor including an impeller and a scroll which is disposed around the impeller and includes a flow passage formed in a rotation direction of the impeller, in which the scroll includes a winding end portion on an end point side of the flow passage in the rotation direction, a discharge potion connected to the winding end portion, a winding start portion connected to the discharge potion on a start point side of the flow passage in the rotation direction, and a flow passage inner surface facing the flow passage, and in which when a projection plane is assumed for the scroll in a case in which a viewing point is located on a fluid suction side and on a rotation axis of the impeller, a reference start point on the rotation axis side in a connection portion between the winding start portion and the discharge potion and a reference end point on the rotation axis side in the winding end portion are assumed for the flow passage inner surface projected to the projection plane, and a reference line connecting the reference start point and the reference end point is assumed for the projection plane, the flow passage inner surface of the projection plane includes a curved protrusion portion protruding toward the outside corresponding to a centrifugal direction in relation to the reference line.

Another embodiment of the present disclosure provides a centrifugal compressor including an impeller and a scroll which is disposed around the impeller and includes a flow passage formed in a rotation direction of the impeller, in which the scroll includes a discharge potion disposed on an end point side of the flow passage in the rotation direction, a winding start portion connected to the discharge potion on a start point side of the flow passage in the rotation direction, and a flow passage inner surface facing the flow passage, and in which when a projection plane is assumed for the scroll in a case in which a viewing point is located on a fluid suction side and on a rotation axis of the impeller, a reference start point on the rotation axis side in a connection portion between the winding start portion and the discharge potion and a reference end point on the rotation axis side at a position having a rotation angle of −60° with respect to the reference start point are assumed for the flow passage inner surface projected on the projection plane, and a reference line connecting the reference start point and the reference end point is assumed for the projection plane, the flow passage inner surface on the projection plane includes a curved protrusion portion which protrudes toward the outside corresponding to a centrifugal direction in relation to the reference line.

Advantageous Effects of Invention

According to some embodiments of the present disclosure, it is possible to improve compression performance by reducing the separation of the fluid passing through the flow passage inside the scroll.

DESCRIPTION OF EMBODIMENTS

Figure 1:
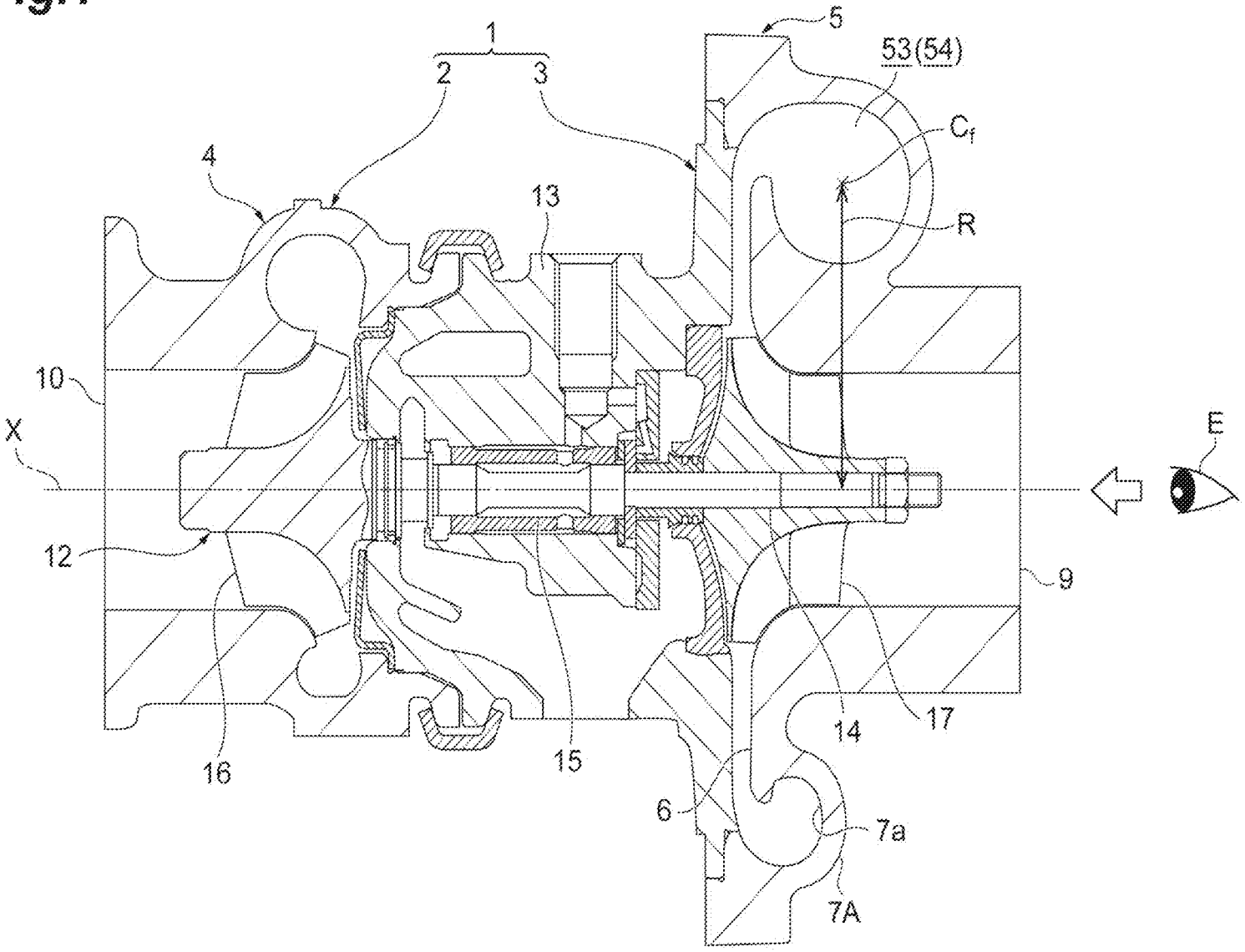
FIG. 1 is a cross-sectional view of a supercharger including a compressor according to an embodiment.

An embodiment of the present disclosure provides a centrifugal compressor including an impeller and a scroll which is disposed around the impeller and includes a flow passage formed in a rotation direction of the impeller, in which the scroll includes a winding end portion on an end point side of the flow passage in the rotation direction, a discharge potion connected to the winding end portion, a winding start portion connected to the discharge potion on a start point side of the flow passage in the rotation direction, and a flow passage inner surface facing the flow passage, and in which when a projection plane is assumed for the scroll in a case in which a viewing point is located on a fluid suction side and on a rotation axis of the impeller, a reference start point on the rotation axis side in a connection portion between the winding start portion and the discharge potion and a reference end point on the rotation axis side in the winding end portion are assumed for the flow passage inner surface projected to the projection plane, and a reference line connecting the reference start point and the reference end point is assumed for the projection plane, the flow passage inner surface of the projection plane includes a curved protrusion portion protruding toward the outside corresponding to a centrifugal direction in relation to the reference line.

The inventor has found that a fluid might be separated from the flow passage inner surface of the scroll and the separation mainly occurred in the vicinity of the connection portion between the winding start portion and the discharge potion. Further, the inventor has contrived the present disclosure by the knowledge that the separation of the fluid could be effectively reduced by providing the curved protrusion portion at that position. That is, according to the above-described embodiment, it is possible to improve compression performance by reducing the separation of the fluid from the flow passage inner surface of the scroll.

In the centrifugal compressor of some embodiments, the protrusion portion and the upstream inner surface on the opposite side of the rotation direction in relation to the protrusion portion, in the flow passage inner surface of the scroll, have a continuous inclination in the tangential direction. In this embodiment, since the upstream inner surface and the protrusion portion are smoothly connected, it is advantageous to suppress the separation of the fluid by forming a smooth flow of the fluid.

In the centrifugal compressor of some embodiments, the protrusion portion and the downstream inner surface on the rotation direction side in relation to the protrusion portion, in the flow passage inner surface of the scroll, have a continuous inclination in the tangential direction. In this embodiment, since the downstream inner surface and the protrusion portion are smoothly connected, it is easy to prevent, for example, the vortex flow at the downstream side of the protrusion portion and it is advantageous to suppress the separation of the fluid.

Another embodiment of the present disclosure provides a centrifugal compressor including an impeller and a scroll which is disposed around the impeller and includes a flow passage formed in a rotation direction of the impeller, in which the scroll includes a discharge potion disposed on an end point side of the flow passage in the rotation direction, a winding start portion connected to the discharge potion on a start point side of the flow passage in the rotation direction, and a flow passage inner surface facing the flow passage, and in which when a projection plane is assumed for the scroll in a case in which a viewing point is located on a fluid suction side and on a rotation axis of the impeller, a reference start point on the rotation axis side in a connection portion between the winding start portion and the discharge potion and a reference end point on the rotation axis side at a position having a rotation angle of −60° with respect to the reference start point are assumed for the flow passage inner surface projected on the projection plane, and a reference line connecting the reference start point and the reference end point is assumed for the projection plane, the flow passage inner surface on the projection plane includes a curved protrusion portion which protrudes toward the outside corresponding to a centrifugal direction in relation to the reference line.

According to this embodiment, it is possible to improve compression performance by reducing the separation of the fluid from the flow passage inner surface of the scroll.

Hereinafter, embodiments of the present disclosure will be described with reference to the drawings. In the description of the drawings, the same reference numerals will be given to the same components and a repetitive description thereof will be omitted.

A supercharger 1 is applied to, for example, an internal combustion engine of a ship or a vehicle. As illustrated in FIG. 1, the supercharger 1 includes a turbine 2 and a compressor (a centrifugal compressor) 3. The turbine 2 includes a turbine housing 4 and a turbine impeller 16 accommodated in the turbine housing 4. The compressor 3 includes a compressor housing 5 and a compressor impeller (an impeller) 17 accommodated in the compressor housing 5. The turbine impeller 16 is provided at one end of the rotation shaft 14 and the compressor impeller 17 is provided at the other end of the rotation shaft 14. A bearing housing 13 is provided between the turbine housing 4 and the compressor housing 5. The rotation shaft 14 is rotatably supported by the bearing housing 13 through a bearing 15 and the rotation shaft 14, the turbine impeller 16, and the compressor impeller 17 rotate about a rotation axis X as an integral rotation body 12.

The turbine housing 4 is provided with an exhaust gas inlet (not illustrated) and an exhaust gas outlet 10. An exhaust gas discharged from an internal combustion engine (not illustrated) flows into the turbine housing 4 through the exhaust gas inlet, rotates the turbine impeller 16, and then flows to the outside of the turbine housing 4 through the exhaust gas outlet 10.

The compressor housing 5 is provided with a suction portion 9 and a discharge portion (not illustrated). When the turbine impeller 16 rotates, the compressor impeller 17 rotates through the rotation shaft 14. The rotating compressor impeller 17 sucks an external gas (a fluid) such as air through the suction portion 9, compresses the fluid, and discharges the fluid from the discharge potion. The compressed gas discharged from the discharge portion is supplied to the above-described internal combustion engine.

The compressor housing 5 includes a diffuser 6 which is disposed in the periphery of the compressor impeller 17 and a scroll 7A which is disposed in the periphery of the diffuser 6. The scroll 7A includes a volute portion 71 (see FIG. 2) which is disposed in a single spiral shape around the compressor impeller 17 and a discharge potion 72 which is integrally formed with the volute portion 71. The scroll 7A is formed to include a flow passage 53. That is, the scroll 7A is provided with the flow passage 53 through which a gas introduced from the diffuser 6 passes and the scroll 7A includes a flow passage inner surface 7*a* which faces the flow passage 53.

The flow passage 53 (see FIG. 3) of the scroll 7A includes a scroll flow passage 54 which is formed inside the volute portion 71 and a discharge flow passage 55 which communicates with the scroll flow passage 54 and is formed inside the discharge potion 72. The scroll flow passage 54 is a flow passage which is formed along the rotation direction Rd of the compressor impeller 17 and is connected to the discharge flow passage 55 to follow the flow of the gas as an example on the end point side of the rotation direction Rd. Further, the start point side of the scroll flow passage 54 is connected to the side portion of the discharge flow passage 55. Additionally, the direction of the discharge flow passage 55 is not limited to, for example, the tangential direction on the end point side of the scroll flow passage 54 and the direction may be changed by appropriate bending or the like based on the relationship of the peripheral devices or pipes.

The volute portion 71 includes a winding start portion 71*a* which is the start point side of the scroll flow passage 54 and a winding end portion 71*b* which is the end point side of the scroll flow passage 54. The winding start portion 71*a* is a portion in which the scroll flow passage 54 is connected to the side portion of the discharge flow passage 55 and a tongue portion 71*c* is formed at the outside corresponding to a centrifugal direction D of the winding start portion 71*a*, that is, the opposite side to the rotation axis X (the inside) with the scroll flow passage 54 interposed therebetween. Additionally, when the upstream end and the downstream end inside the scroll flow passage 54 are assumed based on the flow of the fluid along the rotation direction Rd inside the scroll flow passage 54, the start point side of the scroll flow passage 54 substantially means a portion corresponding to the upstream end and the end point side substantially means a portion corresponding to the downstream end.

The winding end portion 71*b* means the end position of the rotation direction Rd in which A/R can be defined when designing the scroll 7A and is generally set to a maximum value in many cases. Additionally, the winding end portion 71*b* can be also defined as the position of the maximum rotation angle in which A/R can be defined in design when the rotation angle is assumed based on the winding start portion 71*a*. The scroll flow passage 54 is formed in a substantially circular shape as an example in a cross-section including the rotation axis X and following the rotation axis X, "R" (see FIG. 1) indicates a distance from a centroid Cf of this cross-section to the rotation axis X, and "A" means a substantially circular cross-sectional area. Additionally, in the case of the scroll 7A according to the embodiment, the rotation angle α (see FIG. 3) with respect to the reference start point Ba to be described later becomes the winding end portion 71*b* and the rotation angle α indicates, for example, −60° when the rotation direction Rd of the compressor impeller 17 is defines as a positive valve.

Figure 2:
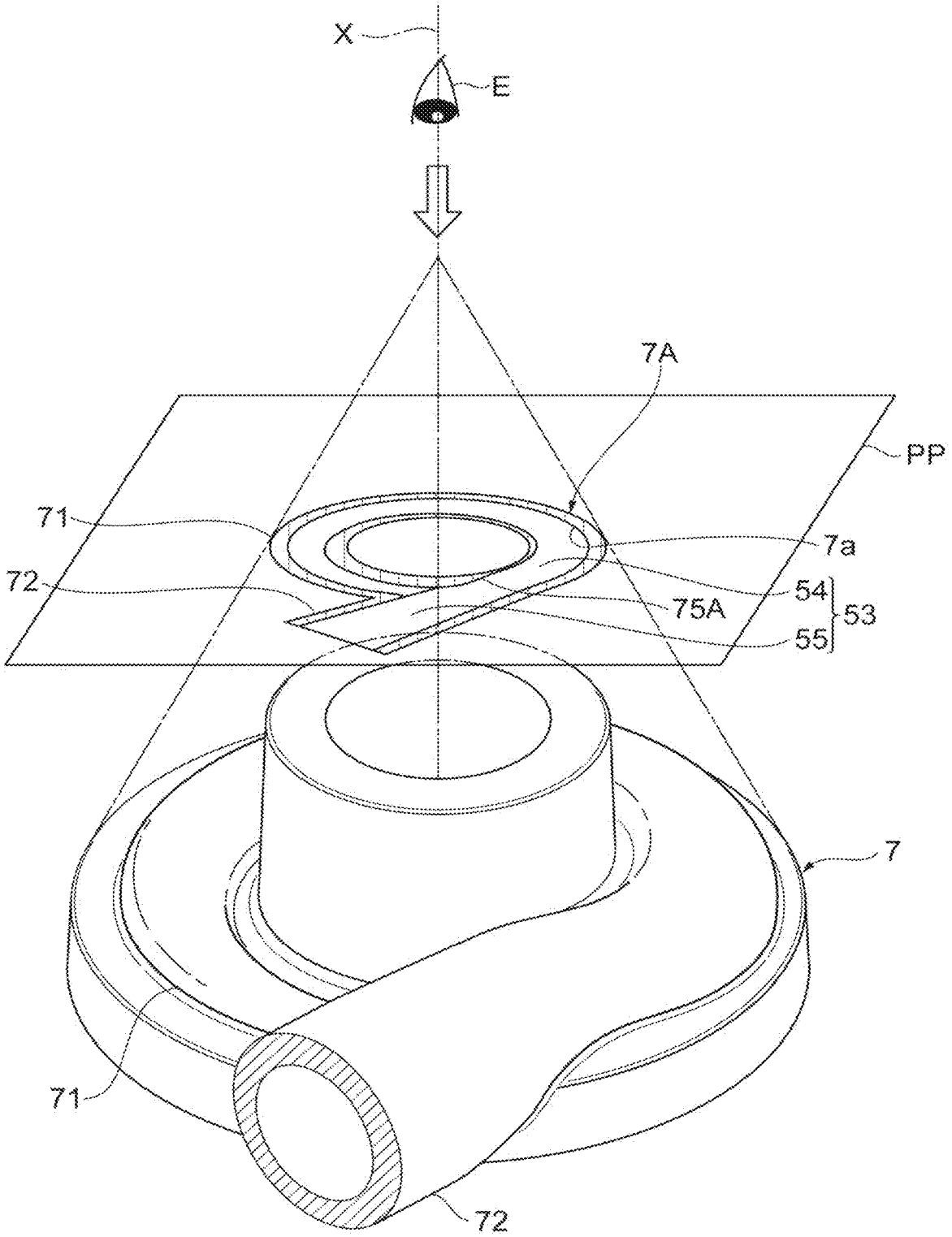
FIG. 2 is a perspective view illustrating a scroll and a projection plane.
Figure 3:
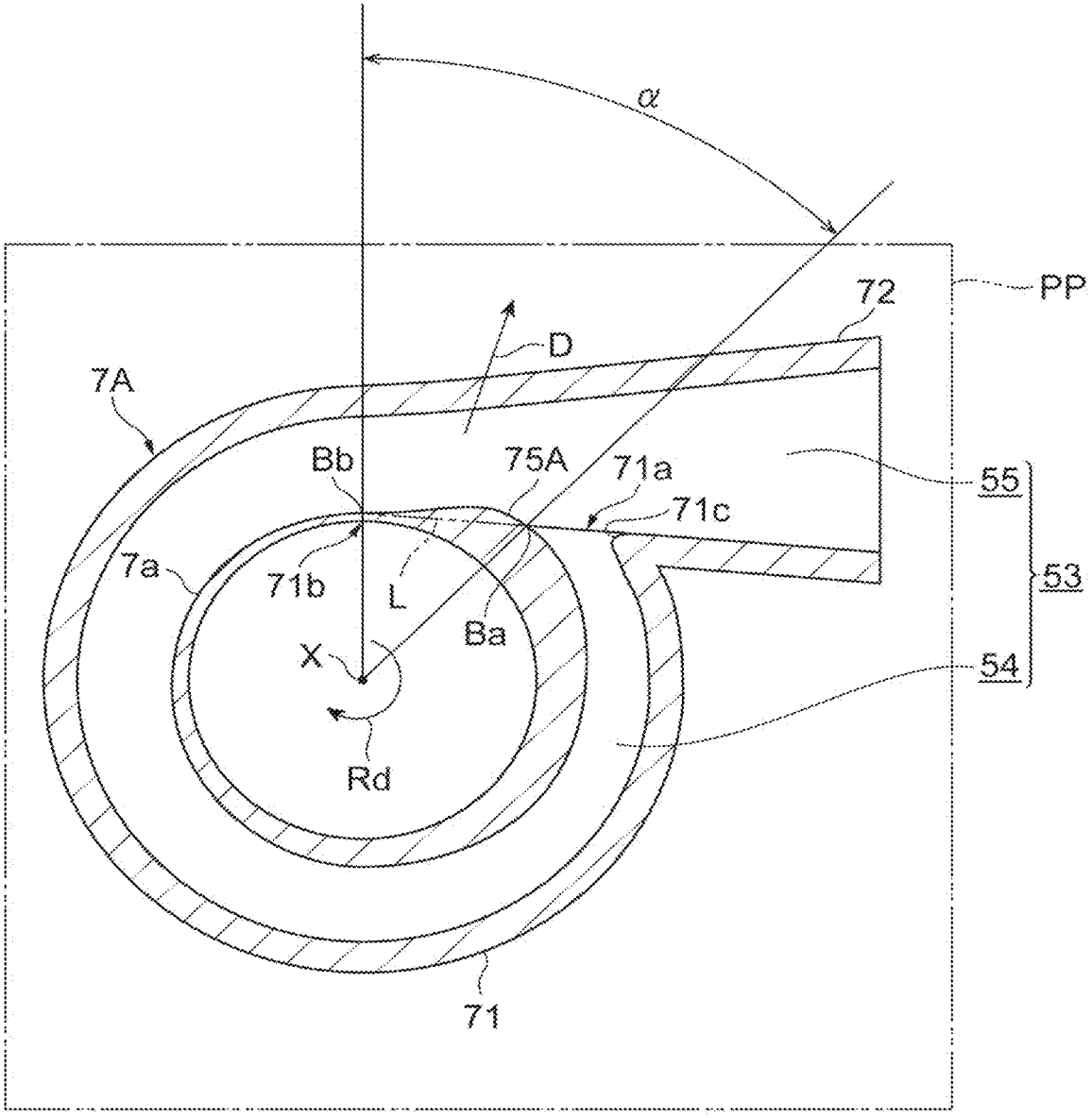
FIG. 3 is a diagram illustrating a scroll according to a first embodiment and illustrating a shape of a flow passage inner surface mainly shown on a projection plane.

As illustrated in FIGS. 2 and 3, a projection plane PP can be assumed for the scroll 7A in a case in which a viewing point E is located on the rotation axis X of the compressor impeller 17 and on a gas suction side. When the flow passage inner surface 7*a* projected on the projection plane PP is verified, a curved protrusion portion 75A is formed in the discharge potion 72 in the embodiment. The protrusion portion 75A will be described in detail.

As illustrated in FIG. 3, when the flow passage inner surface 7*a* on the projection plane PP is viewed, a point on the rotation axis X side (the inside) and a point on the tongue portion 71*c* side (the outside) having the scroll flow passage 54 interposed therebetween can be assumed for the connection portion between the winding start portion 71*a* and the discharge potion 72, and the inner point is assumed as the reference start point Ba. Further, a point on the rotation axis X side (the inside) and a point on the outside having the discharge flow passage 55 interposed therebetween can be assumed for the winding end portion 71*b*, and the inner point is assumed as the reference end point Bb. Next, a reference line L connecting the reference start point Ba and the reference end point Bb is assumed on the projection plane PP. Here, the flow passage inner surface 7*a* of the scroll 7A according to the embodiment includes a portion which protrudes toward the outside corresponding to the centrifugal direction D in relation to the reference line L and the protruding portion is a curved protrusion portion 75A. The protrusion portion 75A is formed in a smooth curve shape in which a tangential inclination is continuous on the whole and may include a line portion in a part thereof.

Figure 4:
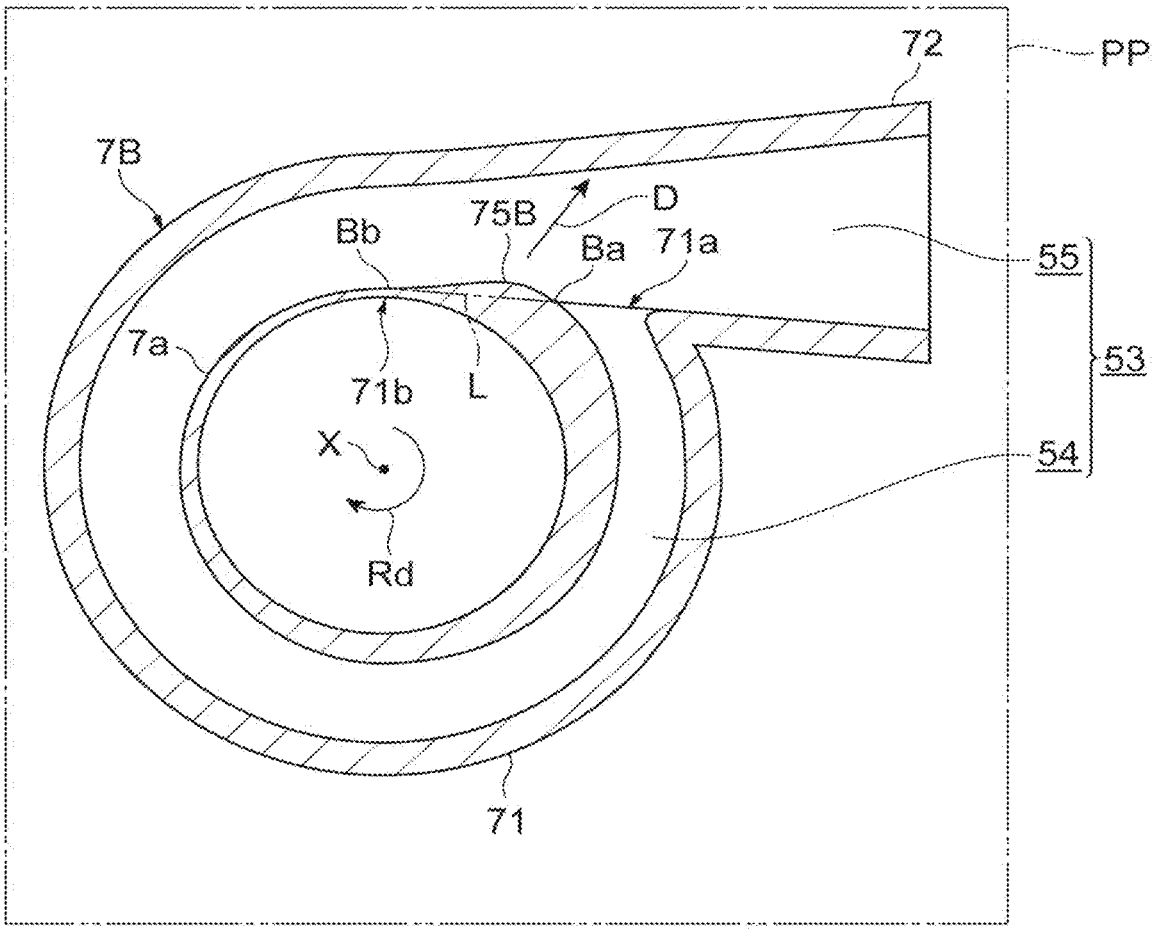
FIG. 4 is a diagram illustrating a scroll according to a second embodiment and illustrating a shape of a flow passage inner surface mainly shown on a projection plane.
Figure 5:
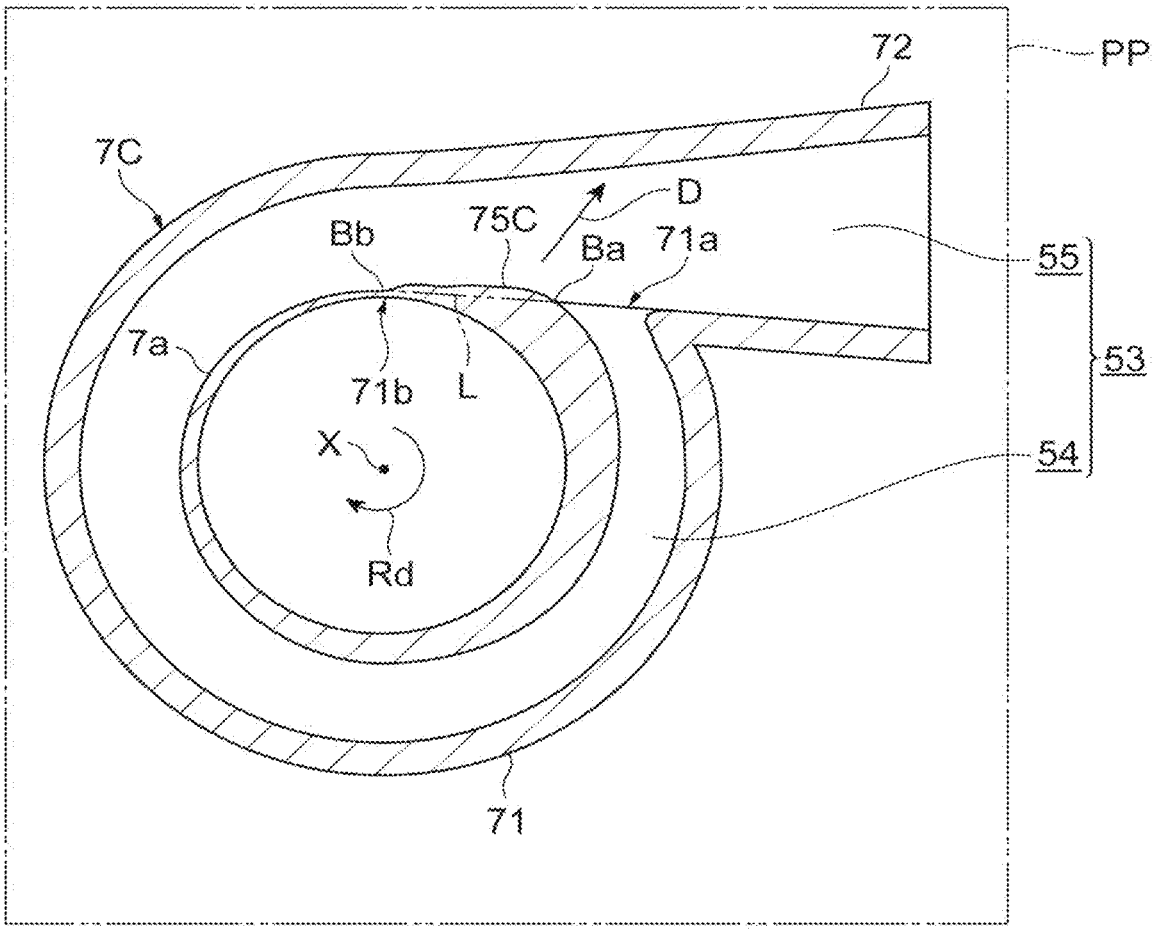
FIG. 5 is a diagram illustrating a scroll according to a third embodiment and illustrating a shape of a flow passage inner surface mainly shown on a projection plane.
Figure 6:
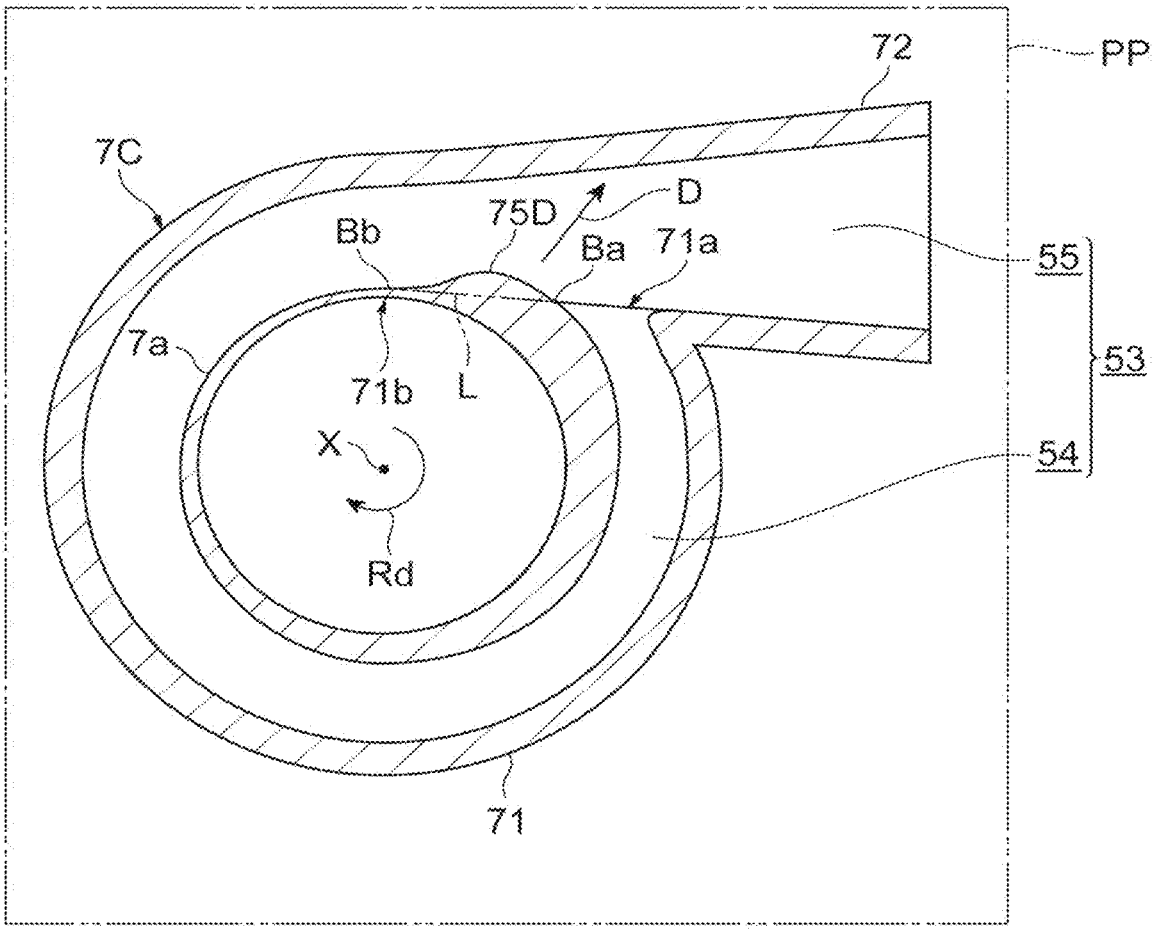
FIG. 6 is a diagram illustrating a scroll according to a fourth embodiment and illustrating a shape of a flow passage inner surface mainly shown on a projection plane.

FIG. 4 is a diagram according to the second embodiment and a curved protrusion portion 75B protruding toward the outside corresponding to the centrifugal direction D in relation to the reference line L is provided. FIG. 5 is a diagram according to the third embodiment and a curved protrusion portion 75C protruding toward the outside corresponding to the centrifugal direction D in relation to the reference line L is provided. FIG. 6 is a diagram according to the fourth embodiment and a curved protrusion portion 75D protruding toward the outside corresponding to the centrifugal direction D in relation to the reference line L is provided.

Figure 7:
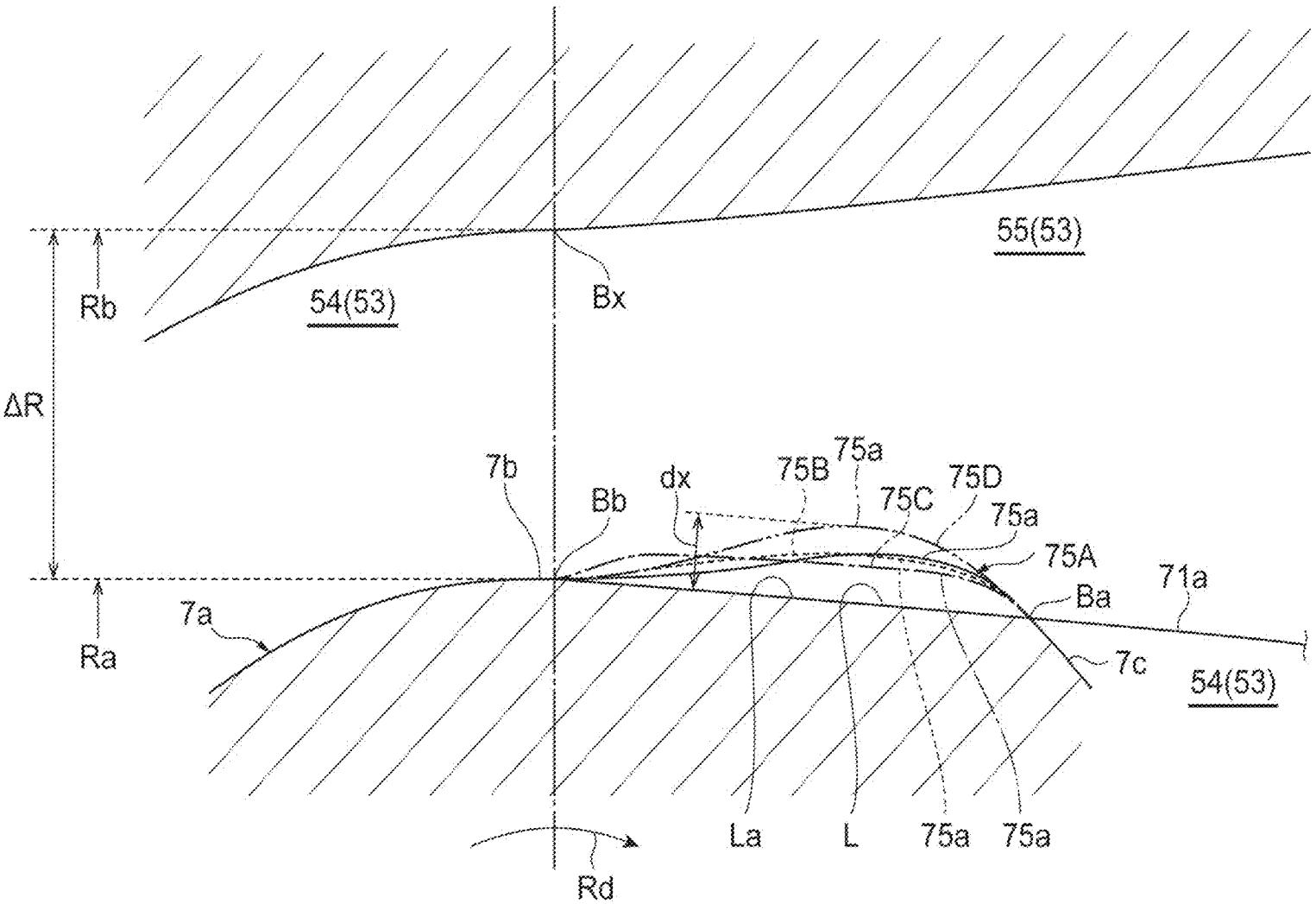
FIG. 7 is a diagram provided to compare shapes of protrusion portions shown on the projection plane in the scrolls according to the first to fourth embodiments.

FIG. 7 is a diagram provided to compare the protrusion portions 75A, 75B, 75C, and 75D according to the embodiments, where the protrusion portion 75A according to the first embodiment is indicated by a solid line, the protrusion portion 75B according to the second embodiment is indicated a dashed line, the protrusion portion 75C according to the third embodiment is indicated by a one-dotted chain line, and the protrusion portion 75D according to the fourth embodiment is indicated by a two-dotted chain line.

In the above-described embodiments, the protrusion portions 75A, 75B, 75C, and 75D and the upstream inner surface 7*b* on the opposite side of the rotation direction Rd in relation to the protrusion portions 75A, 75B, 75C, and 75D in the flow passage inner surface 7*a* have a continuous inclination in the tangential direction. That is, the upstream inner surface 7*b* is smoothly connected to the protrusion portions 75A, 75B, 75C, and 75D without acute bending or the like.

Further, the protrusion portions 75A, 75B, 75C, and 75D and the downstream inner surface 7*c* in the normal direction of the rotation direction Rd in relation to the protrusion portions 75A, 75B, 75C, and 75D in the flow passage inner surface 7*a* have a continuous inclination in the tangential direction. That is, the protrusion portions 75A, 75B, 75C, and 75D and the downstream inner surface 7*c* are smoothly connected without bending or the like.

Further, the most protruding positions 75*a* of the protrusion portions 75A, 75B, 75C, and 75D according to the first, second, third, and fourth embodiments, that is, the positions protruding most from the reference line L of the protrusion portions 75A, 75B, 75C, and 75D on the projection plane PP are provided on the reference start point Ba side in relation to the center La of the reference line L.

Here, the protrusion ratios Pr of the protrusion portions 75A, 75B, 75C, and 75D are defined by the following equation (1). Specifically, a distance between the most protruding position 75*a* of each of the protrusion portions 75A, 75B, 75C, and 75D and the reference line L is indicated by dx. Further, as described above, a point on the rotation axis X side (the inside) and an outer point Bx having the discharge flow passage 55 interposed therebetween can be assumed in the winding end portion 71*b*, a distance from the reference end point Bb corresponding to the inner point to the rotation axis X is defined as the innermost radius Ra, and a distance from the outer point Bx to the rotation axis X is defined as the outermost radius Rb. Then, a difference between the outermost radius Rb and the innermost radius Ra is defined as the radius difference ΔR and a ratio of the distance dx with respect to the radius difference ΔR is defined as the protrusion ratio Pr.

$$Pr=dx/(Rb-Ra) \quad (1)$$

The protrusion ratio Pr can be set to, for example, 0.050 or more and is further desirably 0.100 or more. Further, the protrusion ratio Pr can be set to 0.400 or less, is desirably 0.300 or less, and is further desirably 0.200 or less. Specifically, the protrusion ratio Pr of the protrusion portion 75A according to the first embodiment is 0.147, the protrusion ratio Pr of the protrusion portion 75B according to the second embodiment is 0.140, the protrusion ratio Pr of the protrusion portion 75C according to the third embodiment is 0.110, and the protrusion ratio Pr of the protrusion portion 75C according to the fourth embodiment is 0.223.

Additionally, in the above-described embodiments, the protrusion portions 75A, 75B, 75C, and 75D protrude toward the outside corresponding to the centrifugal direction D in the entire area of the reference line L connected from the reference start point Ba to the reference end point Bb. However, the protrusion portions 75A, 75B, 75C, and 75D may protrude in a part of the reference line L. For example, the upstream inner surface 7*b* may be formed to overlap the reference line L from the reference end point Bb. Further, the downstream inner surface 7*c* may be formed to overlap the reference line L from the reference start point Ba. Further, the protrusion portions 75A, 75B, 75C, and 75D are connected to the upstream inner surface 7*b* or the downstream inner surface 7*c*. As a result, a part of the reference line L may protrude.

Next, the operations and effects of the compressor 3 including the scrolls 7A, 7B, 7C, and 7D according to the above-described embodiments will be described. The inventor has found a possibility that the fluid might be separated from the flow passage inner surface 107*a* of the scroll 107 in the comparative embodiment illustrated in FIG. 9(*a*) and has found knowledge that the separation mainly occurred in the vicinity of the connection portion between the winding start portion 171*a* and the discharge potion 172 and easily occurred in the flow passage inner surface 107*a* on the inside near the rotation axis.

Examining the occurrence of the separation based on the law of conservation of angular momentum, for example, the angular velocity of the flowing gas increases the closer it approaches the rotation axis. That is, since the angular velocity of the gas flowing along the flow passage inner surface 107*a* on the inside near the rotation axis increases, it becomes an environment in which the separation of the gas easily occurs.

Here, the inventor has considered a method of reducing the occurrence of the separation by protruding the flow passage inner surface so as to fill a region in which the separation easily occurs and has performed a careful examination based on that consideration. As a result, the inventor has found that the separation of the fluid can be reduced by providing the protrusion portions 75A, 75B, 75C, and 75D. As a result, compression performance can be improved.

Figure 8:
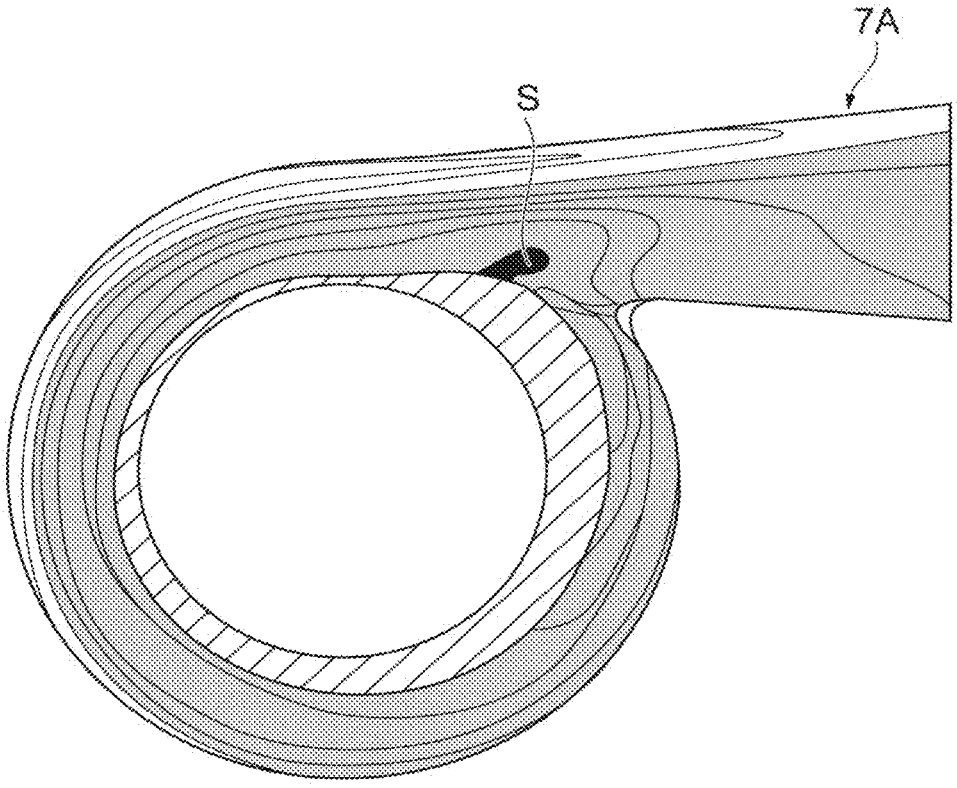
FIG. 8 is a diagram illustrating entropy contours depicted by connecting isentropic points in the scroll according to the first embodiment.
Figure 9:
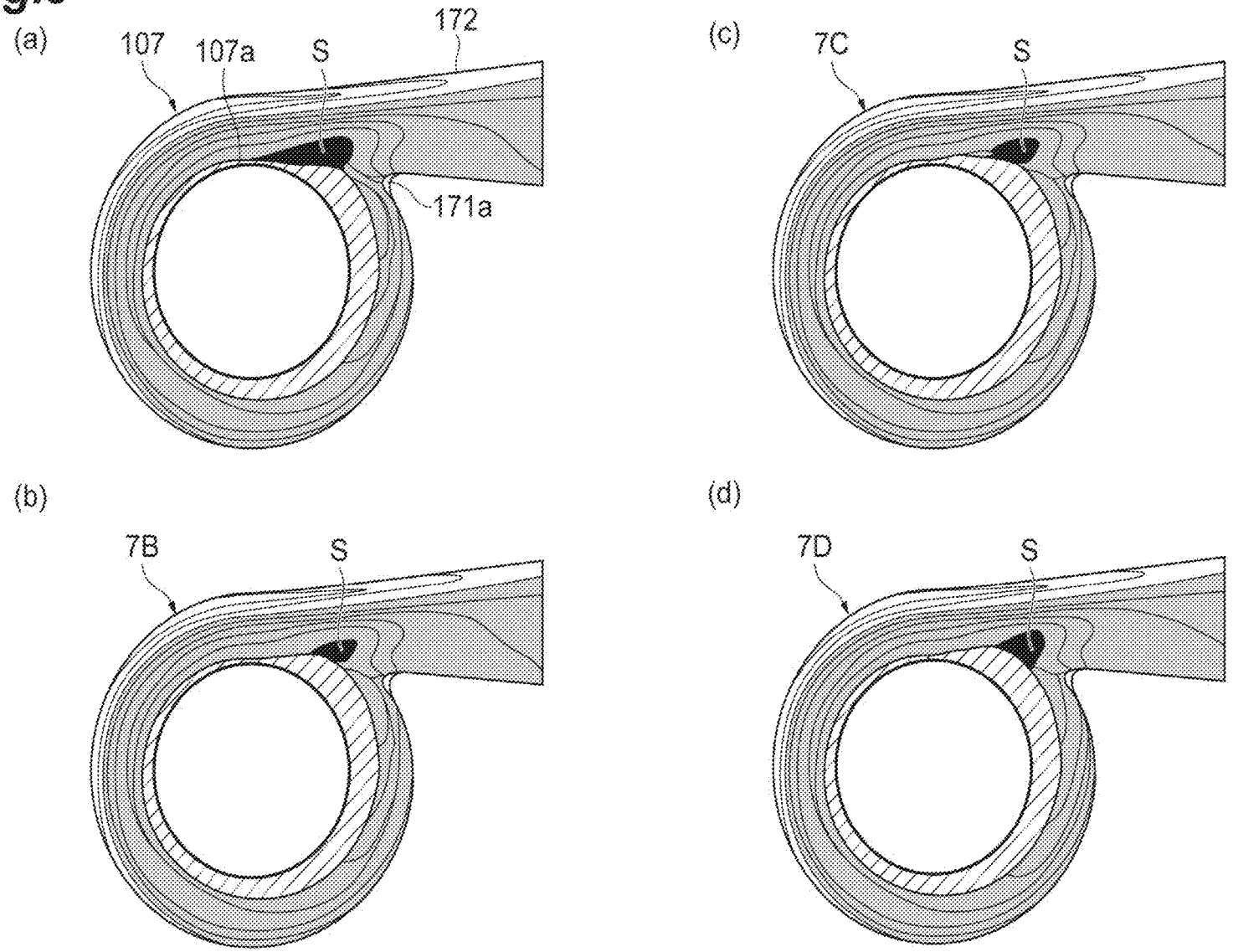
FIG. 9 is a diagram illustrating a comparative embodiment without a protrusion portion and entropy contours of the scrolls according to the second to fourth embodiments, where FIG. 9(*a*) is a diagram of the comparative embodiment, FIG. 9(*b*) is a diagram of the second embodiment, FIG. 9(*c*) is a diagram of the third embodiment, and FIG. 9(*d*) is a diagram of the fourth embodiment.

For example, FIG. 8 is a diagram illustrating entropy contours depicted by connecting isentropic points in the scroll 7A according to the first embodiment and FIG. 9(*a*) is a diagram illustrating entropy contours depicted by connecting isentropic points in the scroll 107 according to the comparative embodiment. In the diagrams illustrated in FIGS. 8 and 9(*a*), the black region S indicates a separation portion, but the black region S illustrated in FIG. 8 is smaller than the black region S illustrated in FIG. 9(*a*).

Figure 10:
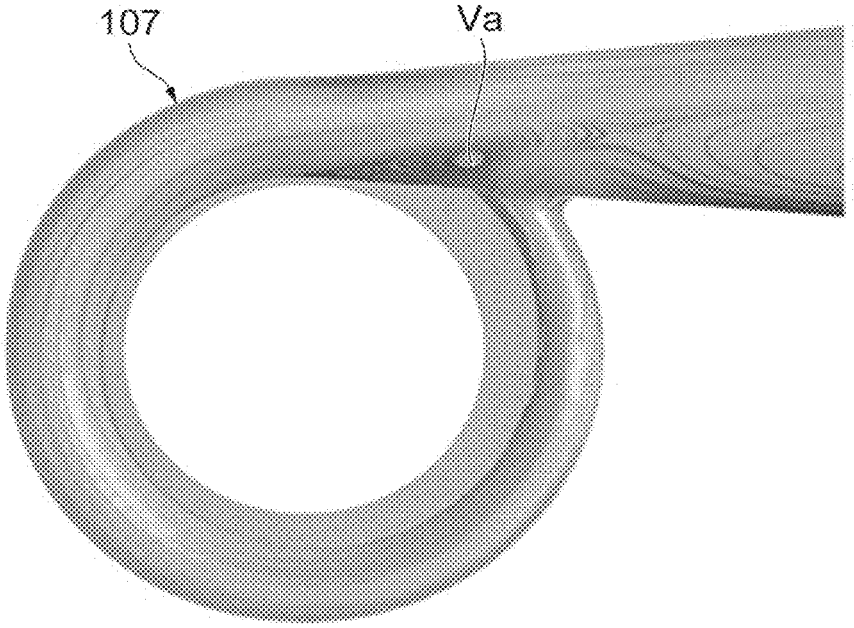
FIG. 10 is a diagram illustrating a Mach number contour of the scroll according to the first embodiment and the comparative embodiment without the protrusion portion.
Figure 10:
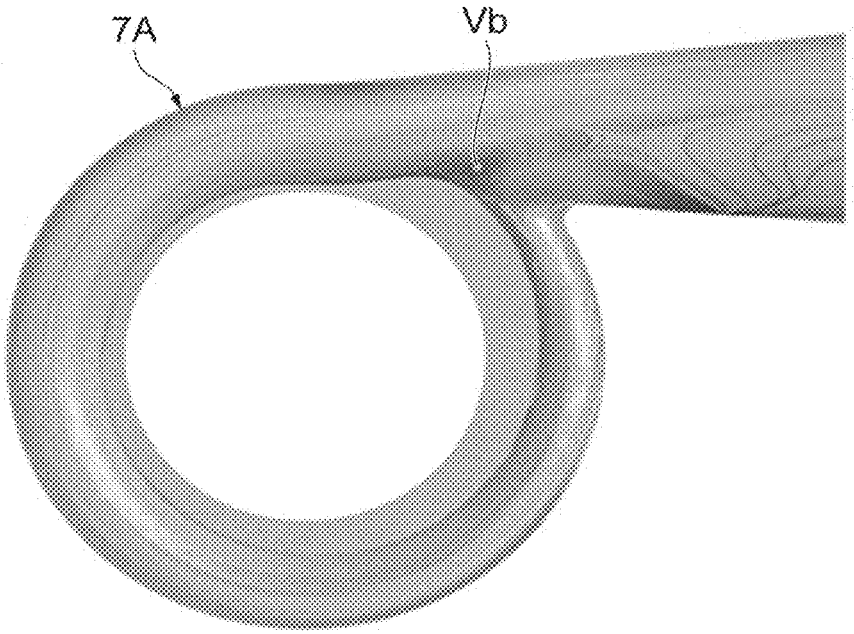

Further, FIG. 10(*a*) is a diagram illustrating a Mach number contour of the scroll 107 according to the comparative embodiment and FIG. 10(*b*) is a diagram illustrating a Mach contour of the scroll 7A according to the first embodiment. FIG. 10(*a*) illustrates a large vortex flow Va generated at a separation position and FIG. 10(*b*) illustrates an extremely small vortex flow Vb generated at that position. As a result, since the pressure loss of the scroll 7A according to the first embodiment is small as compared with the comparative embodiment, and improved compression performance can thus be inferred.

Further, FIG. 9(*b*) is a diagram illustrating entropy contours of the scroll 7B according to the second embodiment, FIG. 9(*c*) is a diagram illustrating entropy contours of the scroll 7C according to the third embodiment, and FIG. 9(*d*) is a diagram illustrating entropy contours of the scroll 7D according to the fourth embodiment. Black regions S according to the second to fourth embodiments illustrated in FIGS. 9(*b*) to 9(*d*) are smaller than the black region S illustrated in FIG. 9(*a*) according to the comparative embodiment. That is, since the pressure loss of the scrolls 7B, 7C, and 7D according to the second to fourth embodiments is small as compared with the comparative embodiment, and improved compression performance can thus be inferred.

Additionally, when the scrolls 7A, 7B, 7C, and 7D according to the first to fourth embodiments are compared with one another, the separation of the gas most hardly occurs in the scroll 7A of the first embodiment. Next, in the scrolls 7B and 7C according to the second and third embodiments, the separation of the gas hardly occurs. It can be inferred that the gas separates somewhat easily in the scroll 7D according to the fourth embodiment in comparison to the scrolls 7A, 7B, and 7C according to the first, second, and third embodiments.

Further, in the scrolls 7A, 7B, 7C, and 71) according to the first to fourth embodiments, since the upstream inner surface 7*b* is smoothly connected to the protrusion portions 75A, 75B, 75C, and 75D, it is advantageous to suppress the separation of the gas by forming a smooth flow of the gas. Further, since the downstream inner surface 7*c* is smoothly connected to the protrusion portions 75A, 75B, 75C, and 75D, it is easy to prevent, for example, the vortex flow at the downstream side of the protrusion portions 75A, 75B, 75C, and 75D and it is advantageous to suppress the separation of the gas. Additionally, in the scrolls 7A, 7B, 7C, and 7D according to the first to fourth embodiments, the protrusion portions 75A, 75B, 75C, and 75D are smoothly connected to both the upstream inner surface 7*b* and the downstream inner surface 7*c*. However, for example, the protrusion portions 75A, 75B, 75C, and 75D may be smoothly connected to the upstream inner surface 7*b* or the downstream inner surface 7*c*.

The present disclosure can be modified and improved in various forms based on the knowledge of the person skilled in the art based on the above-described embodiments. Further, modified examples of the embodiments can be made by using the technical content disclosed in the above-described embodiments. The configurations of the above-described embodiments can be appropriately combined and used.

Further, the present disclosure is not limited to the application of the supercharger for the vehicle and can be also applied to other applications such as a ship. Further, the present disclosure may be also applied to a centrifugal compressor not used in the supercharger.

REFERENCE SIGNS LIST

3: compressor (centrifugal compressor), 7A, 7B, 7C, 7D: scroll, 7*a*: flow passage inner surface, 7*b*: upstream inner surface, 7*c*: downstream inner surface, 17: compressor impeller, 53: flow passage, 71*b*: winding end portion, 71*a*: winding start portion, 75A, 75B, 75C, 75D: protrusion portion, 75*a*: most protruding position of protrusion portion, E: viewing point, D: centrifugal direction, PP: projection plane, α: rotation angle, Ba: reference start point, Bb: reference end point, L: reference line.

The invention claimed is:

1. A centrifugal compressor comprising:

an impeller; and a scroll which is disposed around the impeller and includes a flow passage formed in a rotation direction of the impeller, wherein the flow passage includes a spiral scroll flow passage along the rotation direction and a discharge flow passage connected to the scroll flow passage in a tangential direction of the scroll flow passage, wherein the scroll includes a discharge portion in which the discharge flow passage is formed, a winding start portion connected to a side portion of the discharge portion as a start point of the scroll flow passage along the rotation direction, a winding end portion connected to the discharge portion as an end point of the scroll flow passage along the rotation direction, and a flow passage inner surface facing the discharge flow passage, wherein when a projection plane in which the scroll is projected onto a plane orthogonal to the rotational axis of the impeller is presumed, the flow passage inner surface on the projection plane includes a reference start point that is a position closest to the winding end portion at the winding start portion and a reference end point that is a position closest to the rotational axis at the winding end portion, and wherein when a reference straight line connecting the reference start point and the reference end point is presumed, the flow passage inner surface of the projection plane includes a curved protrusion portion protruding toward the outside corresponding to a centrifugal direction in relation to the reference straight line.

2. The centrifugal compressor according to claim 1, wherein the protrusion portion and an upstream inner surface on an opposite side of the rotation direction in relation to the protrusion portion, in the flow passage inner surface of the scroll, have a continuous inclination in the tangential direction.

3. The centrifugal compressor according to claim 1, wherein the protrusion portion and a downstream inner surface on the rotation direction side in relation to the protrusion portion in the flow passage inner surface of the scroll have a continuous inclination in the tangential direction.

4. The centrifugal compressor according to claim 2, wherein the protrusion portion and a downstream inner surface on the rotation direction side in relation to the protrusion portion in the flow passage inner surface of the scroll have a continuous inclination in the tangential direction.

5. The centrifugal compressor according to claim 1, wherein a most protruding position of the protrusion portion from the reference straight line on the projection plane is closer to the reference start point than the reference end point.

6. The centrifugal compressor according to claim 2, wherein a most protruding position of the protrusion portion from the reference straight line on the projection plane is closer to the reference start point than the reference end point.

7. The centrifugal compressor according to claim 3, wherein a most protruding position of the protrusion portion from the reference straight line on the projection plane is closer to the reference start point than the reference end point.

8. The centrifugal compressor according to claim 4, wherein a most protruding position of the protrusion portion from the reference straight line on the projection plane is closer to the reference start point than the reference end point.

9. A centrifugal compressor comprising:

an impeller; and a scroll which is disposed around the impeller and includes a flow passage formed in a rotation direction of the impeller, wherein the flow passage includes a spiral scroll flow passage along the rotation direction and a discharge flow passage connected to the scroll flow passage in a tangential direction of the scroll flow passage, wherein the scroll includes a discharge portion in which the discharge flow passage is formed, a winding start portion connected to a side portion of the discharge portion as a start point of the scroll flow passage along the rotation direction, a winding end portion connected to the discharge portion as an end point of the scroll flow passage along the rotation direction, and a flow passage inner surface facing the discharge flow passage, wherein when a projection plane in which the scroll is projected onto a plane orthogonal to the rotational axis of the impeller is presumed, the flow passage inner surface on the projection plane includes a reference start point that is a position closest to the winding end portion at the winding start portion and a reference end point that is a position on the winding end portion and has a rotation angle of −60° with respect to the reference start point, and wherein when a reference straight line connecting the reference start point and the reference end point on the projection plane is presumed, the flow passage inner surface on the projection plane includes a curved protrusion portion which protrudes toward the outside corresponding to a centrifugal direction in relation to the reference straight line.

* * * * *